US010315376B2

(12) United States Patent
Zumbiel

(10) Patent No.: US 10,315,376 B2
(45) Date of Patent: Jun. 11, 2019

(54) SYSTEM AND ASSOCIATED METHOD FOR DIGITAL SCORING OF CARTON BLANKS

(71) Applicant: The C.W. Zumbiel Company, Hebron, KY (US)

(72) Inventor: Edward A. Zumbiel, Union, KY (US)

(73) Assignee: The C.W. Zumbiel Company, Hebron, KY (US)

( * ) Notice: Subject to any disclaimer, the term of this patent is extended or adjusted under 35 U.S.C. 154(b) by 1445 days.

(21) Appl. No.: 14/068,405

(22) Filed: Oct. 31, 2013

(65) Prior Publication Data

US 2014/0128238 A1 May 8, 2014

Related U.S. Application Data

(60) Provisional application No. 61/723,997, filed on Nov. 8, 2012.

(51) Int. Cl.
*B31B 50/00* (2017.01)
*B31B 50/88* (2017.01)
(Continued)

(52) U.S. Cl.
CPC ..... *B31B 50/00* (2017.08); *B31B 50/006* (2017.08); *B31B 50/046* (2017.08);
(Continued)

(58) Field of Classification Search
CPC ..... B31B 1/25; B31B 1/00; B31B 2201/0258; B31B 2201/25; B31B 2201/255;
(Continued)

(56) References Cited

U.S. PATENT DOCUMENTS 3,321,062 A * 5/1967 Brockmuller ..... B31B 1/02 198/415
3,744,384 A 7/1973 Jarritt et al.
(Continued)

FOREIGN PATENT DOCUMENTS

DE 3023274 A1 1/1982
EP 1640938 A1 3/2006
(Continued)

OTHER PUBLICATIONS

European Patent Office; Extended European Search Report; EP 13853610.7; PCT/US2013068674; dated Jun. 23, 2016; 7 pgs.
(Continued)

*Primary Examiner* — Sameh Tawfik
(74) *Attorney, Agent, or Firm* — Wood Herron & Evans LLP

(57) ABSTRACT

A method and system for digitally scoring a substrate prior to completing a carton blank is disclosed. After digitally printing a substrate, it is processed through a series of scoring wheels, male on top, female wheel on bottom. The scoring wheels (and transfer belts which help move the substrate through the wheels) are controlled from the same computer file used to create the graphic image. Subsequent to the first scoring sequence, the substrate is turned 90 degrees and a second scoring sequence takes place. After the scoring sequences have been performed, the substrate continues to the laser die cutter where the same computer or digital file determines where to physically cut the sheet into a carton blank.

11 Claims, 6 Drawing Sheets

(51) Int. Cl.
*B31B 100/00* (2017.01)
*B31B 50/04* (2017.01)
*B31B 50/25* (2017.01)
*B31B 110/35* (2017.01)

(52) U.S. Cl.
CPC ..... *B31B 50/256* (2017.08); *B31B 50/88* (2017.08); *B31B 2100/00* (2017.08); *B31B 2100/0022* (2017.08); *B31B 2110/35* (2017.08)

(58) Field of Classification Search
CPC ..... B31B 2201/88; B31B 2201/95; B31B 2203/066; B31B 2203/082; B31B 50/00; B31B 50/88; B31B 2100/00; B31B 50/046; B31B 50/256; B31B 50/006; B31B 2110/35; B31B 2100/0022; B31F 1/10
USPC ..... 493/396
See application file for complete search history.

(56) References Cited

U.S. PATENT DOCUMENTS 3,758,104 A * 9/1973 Daily ..... B65H 29/00 198/415
4,627,214 A 12/1986 Anderson et al.
4,725,261 A * 2/1988 Millard ..... B26D 1/0006 493/342
5,181,899 A 1/1993 Hill et al.
5,518,103 A * 5/1996 Achelpohl ..... B65G 47/2445 198/415
5,558,318 A 9/1996 Crowley et al.
5,888,183 A * 3/1999 Ruthenberg ..... B31B 1/25 493/160
5,931,462 A * 8/1999 Delfosse ..... B65H 9/002 271/184
6,170,231 B1 * 1/2001 Detterman ..... B65B 5/024 53/207
6,203,482 B1 3/2001 Sandford
6,435,332 B1 * 8/2002 Price ..... B65G 47/244 198/375
6,474,548 B1 * 11/2002 Montross ..... G07D 11/009 235/379
6,615,104 B2 * 9/2003 England ..... G06Q 10/00 53/201
6,694,708 B2 * 2/2004 Brizzi ..... B65B 19/228 493/178
6,932,751 B1 * 8/2005 Ward ..... B29C 66/841 493/187
6,935,484 B2 * 8/2005 Davis ..... B65G 47/244 198/411
7,647,752 B2 * 1/2010 Magnell ..... B65B 5/02 493/52
7,669,842 B2 * 3/2010 Smith ..... B65H 29/12 270/32
7,670,275 B2 * 3/2010 Schaack ..... B31F 1/10 493/396
7,788,883 B2 * 9/2010 Buckley ..... G06Q 30/06 382/154
8,857,301 B2 * 10/2014 Clark ..... B26D 7/20 83/614
9,187,261 B2 * 11/2015 Hoepner ..... B65G 47/2445
9,298,706 B2 * 3/2016 Magnell ..... G06F 17/30
2008/0048386 A1 * 2/2008 Smith ..... B65H 29/12 271/194
2011/0152048 A1 * 6/2011 Gombert ..... B23K 26/0648 493/53
2012/0121802 A1 5/2012 Zimmer et al.
2013/0126489 A1 5/2013 Buschulte
2013/0277341 A1 10/2013 Dvorkin

FOREIGN PATENT DOCUMENTS

EP 2202055 A2 6/2010
GB 1192843 A 5/1970
WO 2011145092 A2 11/2011
WO 2012052985 A1 4/2012

OTHER PUBLICATIONS

International Searching Authority, Notification of Transmittal of the International Search Report and the Written Opinion of the International Searching Authority, or the Declaration, International Application No. PCT/US2013/068674, dated Apr. 4, 2014, 12 pgs.
Highcon Systems Ltd., Highcon Euclid, Brochure, 4 pgs., 2012.
International Preliminary Examining Authority; Notification of Transmittal of International Preliminary Report on Patentability; PCT/US13/68674; dated Jan. 16, 2015; 6 pgs.

* cited by examiner

SYSTEM AND ASSOCIATED METHOD FOR DIGITAL SCORING OF CARTON BLANKS

This claims priority to US Provisional Patent Application Ser. No. 61/723,997, filed Nov. 8, 2012 and hereby incorporated by reference in its entirety.

BACKGROUND OF THE INVENTION

This invention relates generally to cartons and, more particularly, to a system and associated method for digitally scoring carton blanks to be formed into cartons.

The rapid evolution and globalization of trade around the world creates a significant demand for packaging to transfer and distribute goods to different remote areas of the world. The transport of goods may be done by ships, airplanes, trucks, and so on. The transport of goods may be performed by the manufacturer, different suppliers, individual persons and so on. Further, a significant demand for different packaging also takes part in trade. The different packaging may include paperboard cartons which are formed from carton blanks which may have pre-folds and/or embossing, for example, to assist in forming the carton blank into a carton.

Packaging takes a major role in the marketing of goods. The package in which the goods are packed and presented, in a store for example, may determine if or to what degree the goods will be appealing to a potential buyer. Thus the packaging appearance can have a direct effect on the sales of merchandise.

Henceforth, throughout the description, drawings and claims of the present disclosure, the terms package, paperboard box, parcel, box, carton, paperboard box, brochure, flyers, etc. may be used interchangeably. The present disclosure may use the term carton as a representative term for the above group.

One known preliminary requirement to construct a wide range of cartons, is preparing or purchasing a pre-treated paperboard and/or paper based material. Paper based material may be of different types. Exemplary types include paperboard, waxed paper, cartridge paper, art paper, synthetic paper, etc. Henceforth, throughout the description, drawings and claims of the present disclosure, the terms paperboard, card-stock, display board, corrugated fiberboard, paperboards of different paper based material, folding boxboard, carton, blanks, and so on, may be used interchangeably. The present disclosure may use the term paperboard as a representative term for the above group.

The pre-treatment of paperboard may include: creating folding lines along the paperboard to ease and provide accurate folding of the paperboard, piercing the paperboard in different areas, creating embossment in different areas of the paperboard, cutting the raw paperboard into predefined shapes, and so on.

Much attention in the packaging industry currently surrounds digital printing such as the use of computers, digital files and digital print engines, as well as inkjet and electro photographic devices, to position dots of varying sizes and colors onto substrates to create a desired image. And to a lesser, but growing extent, digital die cutting is also gaining momentum. Digital die cutting, in one well known embodiment, makes use of digital files to direct a cutting laser onto a substrate for the purpose of either cutting or perforating the substrate.

While both digital printing and digital die cutting may be well known, the state of the digital carton making art is, however, lacking in that there is no known way to digitally score or crease substrates with fold lines without degrading the integrity of the substrate. Perforating a substrate with a laser may be used to create a score line, but this technique also cuts through and damages the integrity of the substrate in the process.

One technique has been introduced by Highcon which it calls "digital die cutting/scoring." However, this technique requires the creation of a scoring rule from UV curable materials applied by inkjet. In other words, rather than produce steel die rules and bend them in a conventional manner, this Highcon technique generates new die rules from polymers.

One of the hallmarks of true digital printing is the ability of the print engine to print a different image on every carton, card, or substrate without retooling (i.e. new printing plates, cylinders, etc.) In sum, every image can be different, and there is no added tooling, make ready costs or time delays. The same holds true for digital die cutting. A computer file (i.e., .pdf) can direct a laser to cut each subsequent substrate in a shape that is different from the previous one.

There is no known technique to provide the ability to score a substrate with infinite variability. Prior systems may cut digitally, but scoring commonly requires shut down and make ready operations for each variation in the desired scoring pattern.

SUMMARY OF THE INVENTION

These and other shortcomings in the prior art are addressed in various embodiments of this invention. Briefly described, the objects of this invention are achieved by a method and system for digitally scoring a substrate prior to completing a carton blank. After digitally printing a substrate in one embodiment, the web is sheeted (or it could start as a sheet) and is sent through a series of scoring wheels, male wheel on top, female wheel on bottom, in one embodiment. The scoring wheels (and transfer belts which help move the substrate through the wheels) are controlled from the same .pdf (or other computer) file that was used to create the graphic image. One aspect of this invention is that a .pdf file with the desired die line is used to score the substrate. This file instructs the wheels, belts and other equipment to position themselves on the X and Y axes and engage/compress the carton substrate for a particular length in a particular place to score the substrate and produce the desired fold lines to erect the resulting carton blank into a carton.

Subsequent to the first scoring sequence, the substrate is turned 90 degrees, by a gyro-box, a continuous motion robotic arm or other assembly. Because the substrate is typically rectangular, accurately repositioning it 90 degrees in a continuous motion sequence can be accomplished in any one of a variety of ways.

After the 90 degree turn, the second scoring sequence takes place. Same procedure as the first: belts have been positioned from the .pdf or other computer or digital file, scoring wheels in place, and pressure applied for the appropriate duration of time to the substrate so as to create a score or fold line of a specified length, depth and other parameters.

After the scoring sequence has been performed, the substrate may continue to the laser or other die cutter where the same .pdf file determines where to physically cut the sheet into a carton blank.

One aspect of this invention is that score lines along straight lines can be produced. Practically, linear scores or fold lines are utilized in about 99 percent of the folding cartons produced in the world. In various embodiments, four or more score lines in each orthogonal direction can be produced and the score lines may be either parallel or perpendicular to each other. Again, this covers about 95 percent of the world's cartons under this invention. Most cartons tend to follow some variation of the classic parallel-piped theme, e.g. a refrigerator-housed carton containing twelve cylindrical beverage cans or the like.

These and other objects, features, and advantages of this invention will become more apparent upon reading this specification in conjunction with the accompanying drawings.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

A system 10 according to various embodiments of this invention is intended primarily for folding cartons which could be used with cans or bottles, and other types of cylindrical containers, used to contain soft drinks, beverages or beer. Other items constructed from paperboard can also readily make use of this invention. According to an embodiment of the invention, the cans are packaged in a carton that is fully enclosed, except for appropriate dispenser or carrying openings. A blank 12 for forming a carton is illustrated in FIG. 1C according to one embodiment. The blank 12 is formed from a foldable sheet of material, such as paperboard. Examples of cartons formed from such blanks are disclosed in U.S. Pat. Nos. 8,127,925; 8,118,212; 7,614,543; 5,947,367 and 5,682,984, each of which is incorporated by reference herein.

Figure 1:
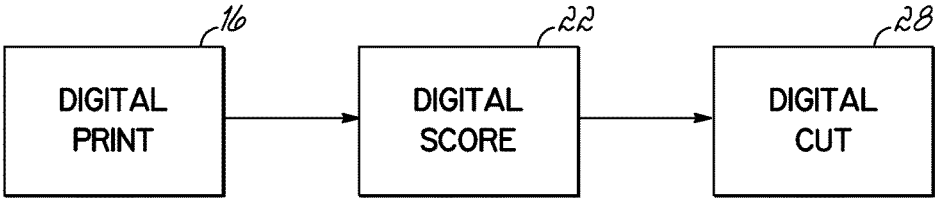
FIG. 1 is a flow chart according to one aspect of this invention.
Figure 1A:
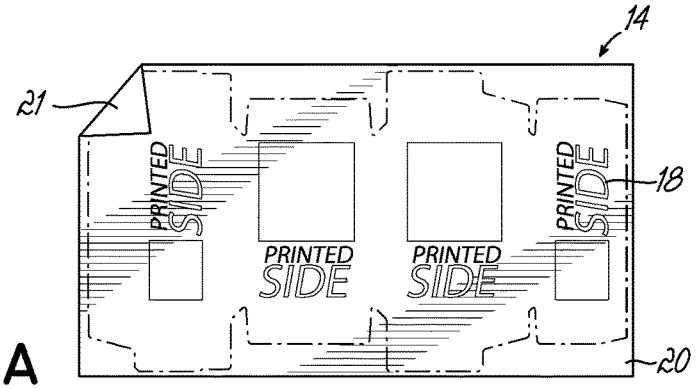
FIGS. 1A-1C are plan views of the output from the respective steps of FIG. 1.
Figure 1B:
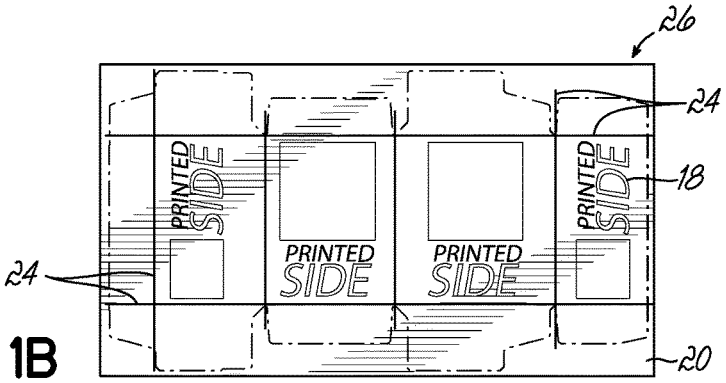
Figure 1C:
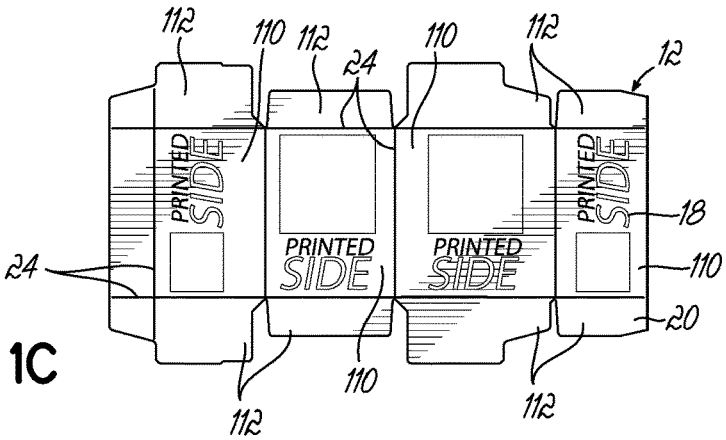

Referring to FIG. 1, a flow chart showing generally the steps according to one embodiment of this invention is shown. Initially, a substrate 14 is printed, digitally or otherwise, 16 with appropriate graphics 18 on a print side 20 of the substrate. The substrate 14 also has an opposite non-print side 21. Digital printing on substrates is well known in the art. A next step according to a method of one embodiment of this invention is to digitally score 22 the printed substrate 14 with the appropriate score or fold lines 24 for erecting the desired carton from the carton blank 12. The process of digitally scoring 22 the substrate 14 into a scored sheet 26 as shown in FIG. 1B will be discussed herein below with respect to FIGS. 2A-3. In various embodiments of this invention, the fold lines 24 may extend across the entire length or width of the substrate 14, just at or beyond the perimeter of the carton blank 12 or combinations of these arrangements.

Those skilled in the art readily appreciate that there is a wide variety of techniques to produce a fold in a substrate such as a sheet of paperboard as one example.

A good functional fold occurs when the paperboard delaminates in the crease into as many thin, undamaged layers as possible. Ply bond strength must be a compromise, so that delamination occurs easily in a crease while the structure holds together in other areas.

Moreover, the substrate 14 may be subject to various other processes in accordance with embodiments of this invention which may or may not result in a fold, such as embossing. The Paperboard Packaging Council (www.ppcnet.org) defines embossing generally as raising areas of a design above the flat surface of carton blanks. They also define a score generally as a crease along which the adjacent elements of a die cut carton blank are folded without cracking or breaking to form a carton. Likewise, they define creasing generally as the production of the score or folding line in a sheet. These and other terms are collectively referred to herein as a score, scoring or variations of such terms as applied to a substrate which may or may not result in a fold in the carton blank and may or may not include a penetration or cut through the structure of the substrate 14.

After the substrate 14 is digitally scored 22, the scored sheet 26 is, in one embodiment, digitally cut 28 via a laser into the shape of the carton blank 12 as shown in FIG. 1C. While the sequential steps of printing 16, scoring 22 and cutting 28 a substrate are shown in one particular order in FIGS. 1-1C, one of ordinary skill in the art will appreciate that these steps may be performed in a different order, combined and/or additional steps may be included throughout the process according to various embodiments of this invention.

Figure 2A:
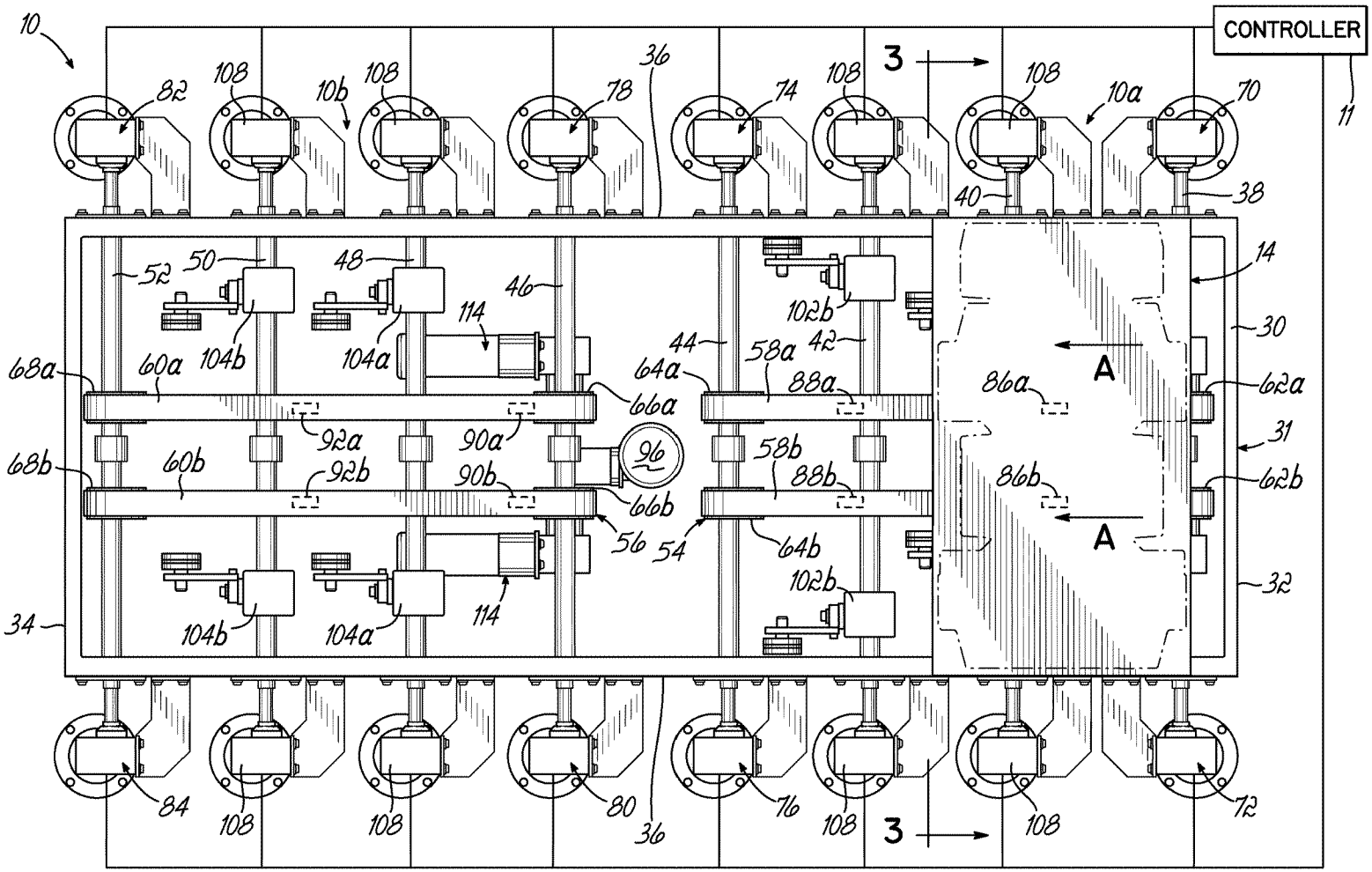
FIGS. 2A-2C are sequential top plan views a lower bed of one embodiment of a system for digitally scoring of carton blanks according to this invention with an upper bed of the system removed for clarity.
Figure 2B:
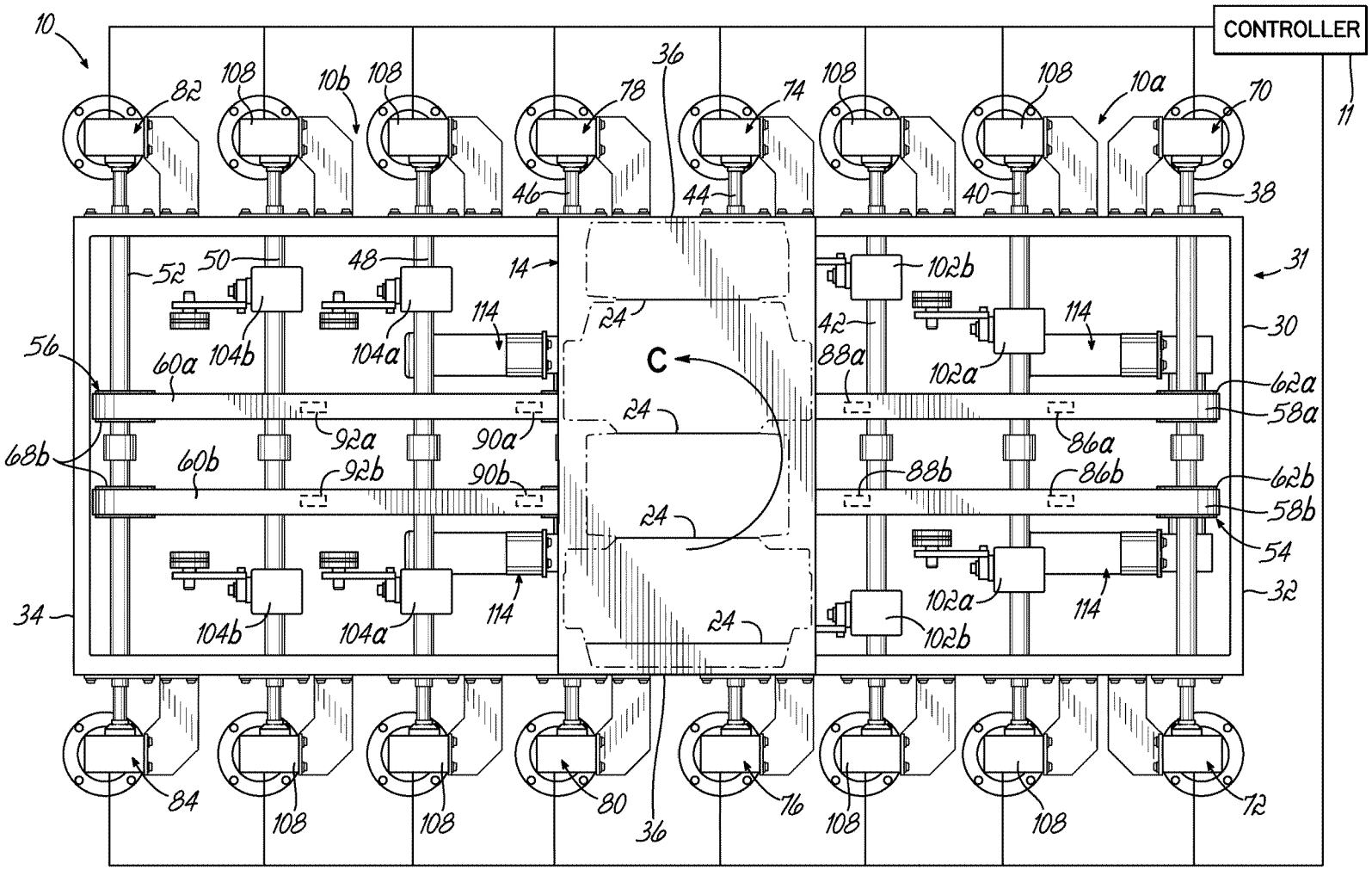
Figure 2C:
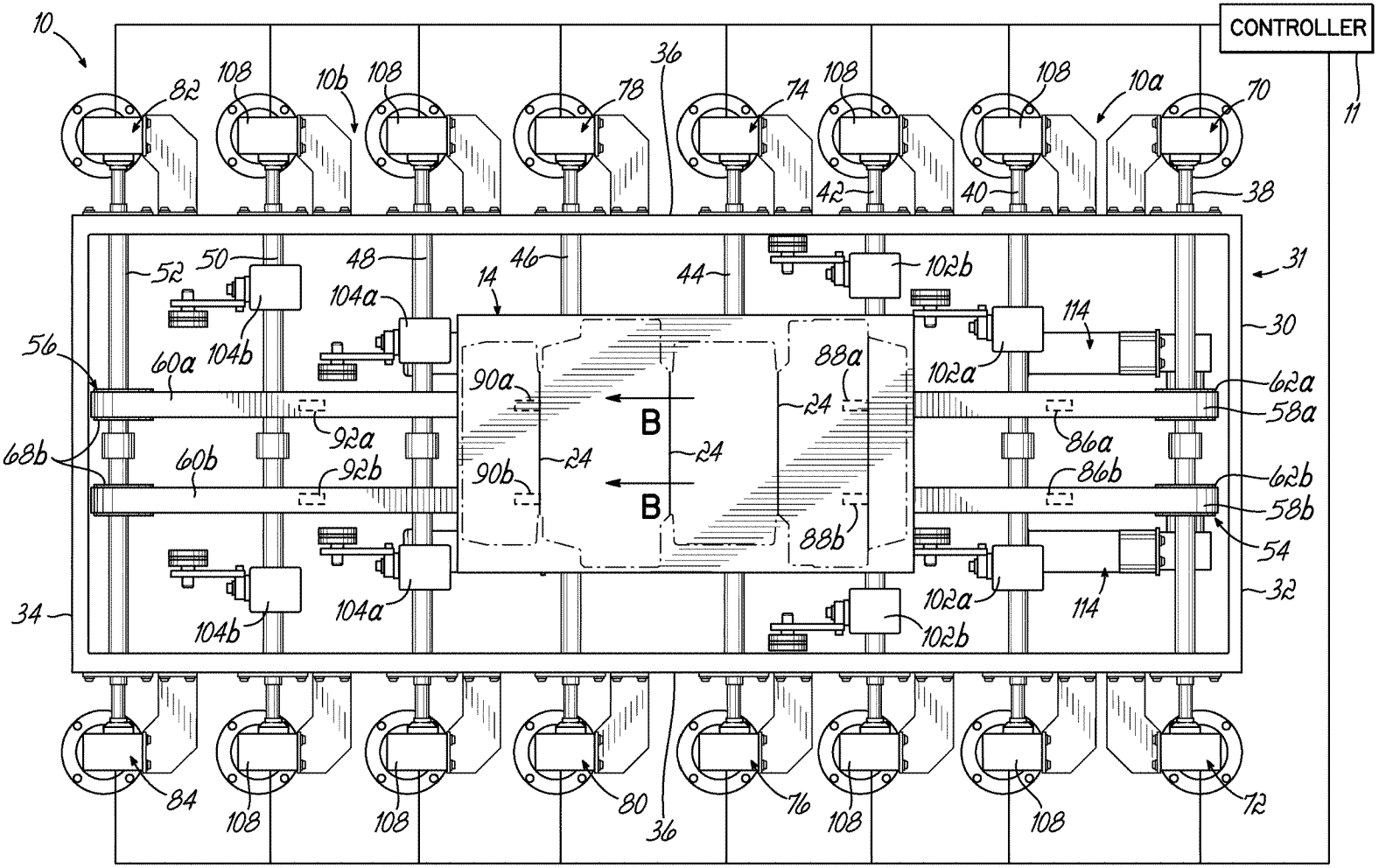
Figure 3:
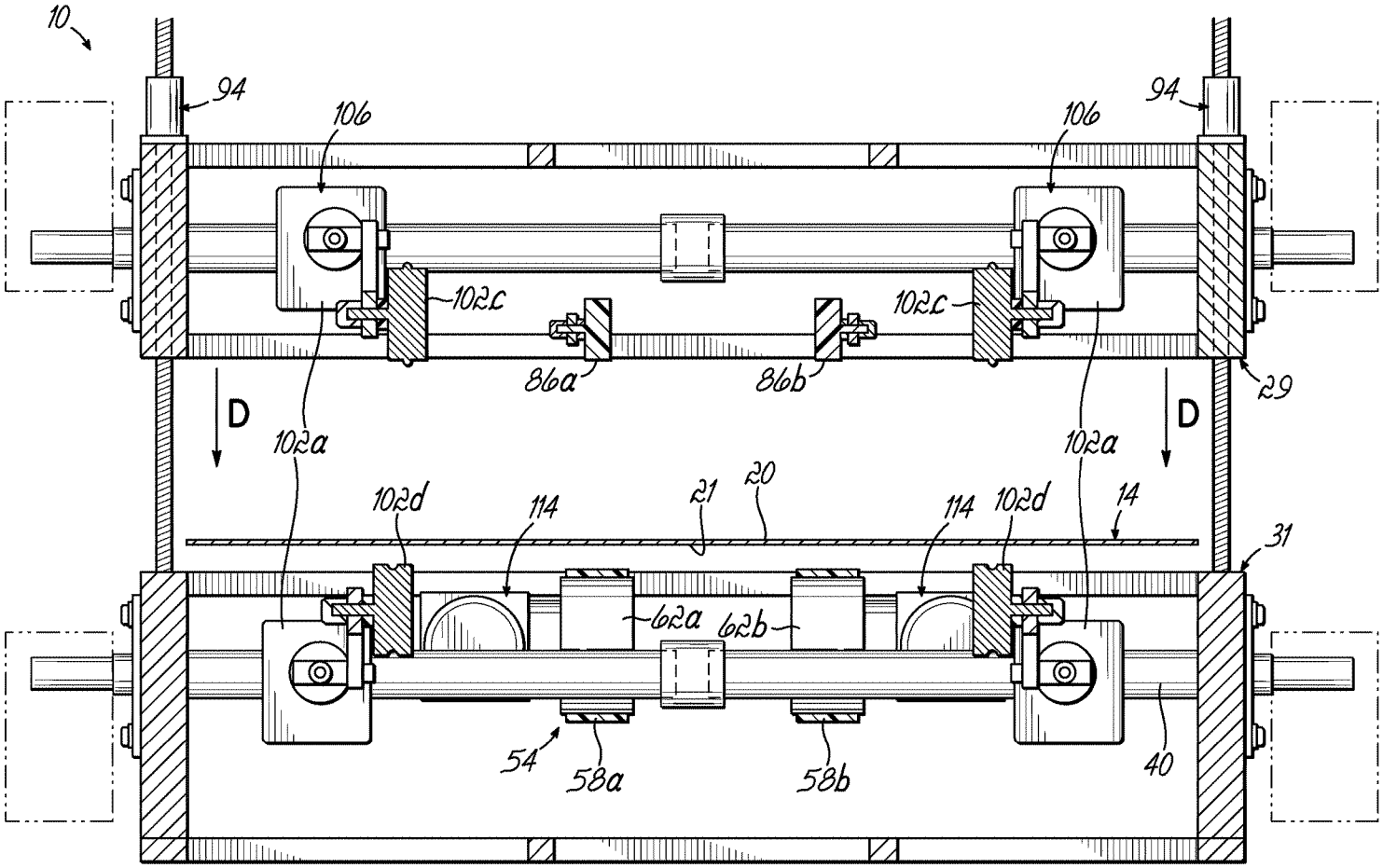
FIG. 3 is a cross-sectional view taken along line 3-3 of FIG. 2A showing both the upper and lower beds of the system.

Referring to FIGS. 2A-2C, one system 10 for digitally scoring the substrate 14 according to this invention is shown in which the substrate 14 is sequentially processed through the system 10 in FIGS. 2A-2C. The system 10 includes an upper bed 29 and a lower bed 31 as shown in FIG. 3 with the substrate 14 passing generally between the beds 29, 31. The lower bed 31 is built upon a generally rectangular frame 30 according to one embodiment with an upstream end 32 of the frame 30 located opposite a downstream end 34 of the frame 30 and lateral side edges 36, 36 extending between the upstream and downstream ends. The view of the system shown in FIGS. 2A-2C is the lower bed 31 of the system 10 with the upper bed 29 of the system 10 removed in FIGS. 2A-2C for clarity. The upper and lower beds 29, 31 of the system 10 are shown in the cross-sectional view taken along line 3-3 of FIG. 2A and FIG. 3. A number of shafts 38, 40, 42, 44, 46, 48, 50, 52 extend between the opposed lateral sides 36 of the frame 30 and are spaced from the upstream end 32 to the downstream end 34 as shown in FIGS. 2A-2C.

The system 10 also includes an upstream conveyor assembly 54 as well as a downstream conveyor assembly 56 for transporting the substrate 14 through the system 10 generally from the upstream end 32 to the downstream end 34. Each of the conveyor assemblies 54, 56 includes a pair of conveyor belts 58*a*, 58*b* and 60*a*, 60*b* which are each trained around upstream and downstream pulleys 62*a*, 62*b*, 64*a*, 64*b*, 66*a*, 66*b*, 68*a*, 68*b*. The upstream pulleys 62*a*, 62*b* of the upstream conveyor assembly 54 are each mounted for rotation on the same shaft 38 and the downstream pulleys 64*a*, 64*b* of the upstream conveyor assembly 54 are commonly mounted on the shaft 44. Similarly, the upstream pulleys 66*a*, 66*b* of the downstream conveyor assembly 56 are mounted on a common shaft 46 and the downstream pulleys 68*a*, 68*b* of the downstream conveyor assembly 56 are commonly mounted on the shaft 52. Each of the pulleys are positioned on the respective shaft by a carrier belt linear adjustment mechanism 70, 72, 74, 76, 78, 80, 82, 84, each of which is mounted to the adjacent lateral side 36 of the frame 30 as shown in FIGS. 2A-2C. Each carrier belt linear adjustment mechanism adjusts the lateral position of one of the pulleys as well as the associated conveyor belt trained around the pulley in a lateral position across the width of the system 10. The carrier belt linear adjustment mechanisms and other operations of the system 10 according to aspects of this invention are controlled by a controller 11 which receives position and other parameters for operation of the system 10 from a digital, computer input file.

On the upstream shaft 38, 46 of each conveyor assembly 54, 56, a conveyor belt drive assembly 114 is mounted on the shaft and the pulleys mounted thereon to drive the conveyor belts in a generally continuous path for advancing the substrate through system 10.

The upstream and downstream conveyor assemblies 54, 56 contact the non-print side 21 of the substrate 14 and advance the substrate 14 through the system 10 from the upstream end 32 to the downstream end 34 of the frame 30. To ensure appropriate contact and frictional engagement between the substrate 14 and the conveyor belts, each conveyor assembly includes a pair of upstream and downstream hold-down wheels 86*a*, 86*b*, 88*a*, 88*b*, 90*a*, 90*b*, 92*a*, 92*b* mounted on the upper bed 29 of the system 10 as shown in FIG. 2A in phantom lines and in FIG. 3 in cross-sectional view. During operation, the upper bed 29 is lowered toward the lower bed 31 by multiple hold-down screw assemblies 94 extending between the frames of the upper and lower beds 29, 31 as shown in FIG. 3. Upon actuation of the hold-down screw assemblies 94 and lowering of the upper bed 29 toward the lower bed 31, the hold-down wheels 86, 88, 90, 92 will sandwich the substrate 14 with the respective conveyor belts 58*a*, 58*b*, 60*a*, 60*b* to securely position and advance the substrate 14 through the system 10. The hold-down wheels 86, 88, 90, 92 engage the print side 20 of the substrate 14 and the conveyor belts 58, 60 engage the non-print side 21 of the substrate 14 in one embodiment of this invention. In alternative embodiments of this invention, conveyor belts may be utilized on both the top and bottom of the substrate 14 or on either the top or bottom of the substrate 14 to advance it through the system 10.

As seen in FIGS. 2A-2C, the upstream conveyor assembly 54 is spaced in a longitudinal direction from the downstream conveyor assembly 56. A substrate rotating assembly 96 is positioned between the upstream and downstream conveyor assemblies 54, 56 as shown most clearly in FIG. 2A. In response to a signal from the controller 11, the substrate rotating assembly 96 rotates the substrate 14 approximately 90 degrees as shown by the arrow C in FIG. 2B. The substrate rotating assembly 96 in various embodiments according to this invention may be a gyro-box such as a Bobst™ mechanism, or a continuous motion robotic arm with or without a pneumatic suction engagement interface.

To form the scores or fold lines 24 in the substrate 14, mating pairs of carton scoring wheel assemblies 100 are located on the shafts within the frames of the system 10. In one embodiment as shown in FIGS. 2A-2C, four pairs of carton scoring members in the form of wheels 102*a*, 102*b* are located in the upstream portion boa of the system 10 and, likewise, four pair of carton scoring members in the form of wheels 104*a*, 104*b* are located in the downstream portion 10*b* of the system 10. Each carton scoring assembly 100 includes an upper male scoring wheel 102*c* or 104*c* mounted on a scoring wheel adjustment mechanism 106 for rotation on the upper bed 29 of the system 10. Each male scoring wheel 102*c*, 104*c* is positioned directly above a complementary female scoring wheel 102*d*, 104*d* on the lower bed 31 of the system 10. The four carton scoring wheel assemblies in the upstream portion boa of the system 10 can be implemented during the production of carton blanks 12 to produce four distinct and generally parallel score or fold lines 24 in the substrate 14. Similarly, the four downstream carton scoring wheel assemblies can likewise produce up to four distinct and parallel fold or score lines 24 in the substrate 14. As is evident in the substrate 14 as shown in FIG. 2B, after the substrate 14 has passed through the upstream portion boa of the system 10, four distinct score or fold lines 24 are formed in the substrate 14 and in the exemplary embodiment of the substrate 14 shown in FIG. 2B, those score or fold lines 24 separate the major panels 110 of the carton blank 12.

In alternative embodiments of this invention, the system 10 may have different dimensions (i.e., wider for accommodating wider substrates) than those shown herein and the system 10 may include more or less scoring wheels arranged as needed in the system 10 for generating the desired fold lines in the substrate 14.

After the substrate 14 is processed through the upstream portion boa of the system 10, it is rotated approximately 90 degrees by the substrate rotating assembly 96 and passed to the downstream portion 10*b* of the system 10 for creasing and generating fold lines 24 which are generally perpendicular to those shown in FIG. 2B. The crease, score or fold lines 24 generated in the downstream portion 10*b* of the system 10 in the exemplary carton blank 12 shown in FIGS. 1B and 1C separate the major panels 110 of the blank 12 from carton end flaps 112. In the embodiment shown in FIGS. 1B and 1C, only two of the carton scoring wheel mechanisms are utilized to create the fold lines 24 in the downstream portion 10*b* of the system 10. Note that the inactive carton scoring wheel mechanisms 104*b*, 104*b* are positioned outboard of the substrate 14 passing through the downstream portion 10*b* of the system 10 because only two fold lines 24 are required to be added to the substrate in the orientation of the substrate 14 in the downstream portion 10*b*.

In a still further embodiment of this invention, the system 10 may include one or more further downstream sections with appropriate substrate rotating assemblies positioned between each pair of adjacent sections for manipulation of the substrate prior to entering the respective downstream section. Moreover, one or more of the sections could be utilized to make non-orthogonal or obtuse fold lines in relation to the fold lines 24 placed on the substrate in the upstream section boa and downstream section 10*b* shown in the FIGS. 2A-2C. This could be accomplished by rotation of the substrate 14 through an arc of less than or greater than 90 degrees. Movable or adjustable guide rails may be added to the system 10 to enable the placement of obtuse score lines as described.

In still further embodiments of this invention, each male and female scoring wheel pair 102, 104 may function independently of other scoring wheel pairs in the system as needed for a particular application. The controller 11 may have any of the scoring wheel pairs 102, 104 engage and/or disengage the substrate 14 independently as required. This may be utilized to produce fold lines on the substrate which are continuous or discontinuous, extend entirely across the substrate 14 or only partially across the substrate 14 or other variations as needed.

Each carton scoring wheel assembly is operatively coupled to a linear adjustment assembly 108 located laterally outboard of the frame 30 in the system 10 as shown in FIGS. 2A-2B. Each substrate scoring linear adjustment assembly 108 receives instructions from the controller to adjust the position of the male and female scoring wheel pairs 102, 104 laterally on the system 10 to the appropriate position for the desired score or fold lines 24 on the substrate 14. Two pair of carton scoring wheel assemblies are mounted on a single shaft as shown in FIGS. 2A-2B. However, the carton scoring wheel assemblies are controlled by individual substrate score linear adjustment assemblies 108 and therefore the position of each carton scoring wheel assembly can be individually adjusted according to the desired position of the resulting fold line 24 in the substrate 14 based on instructions from the controller 11.

Figure 4:
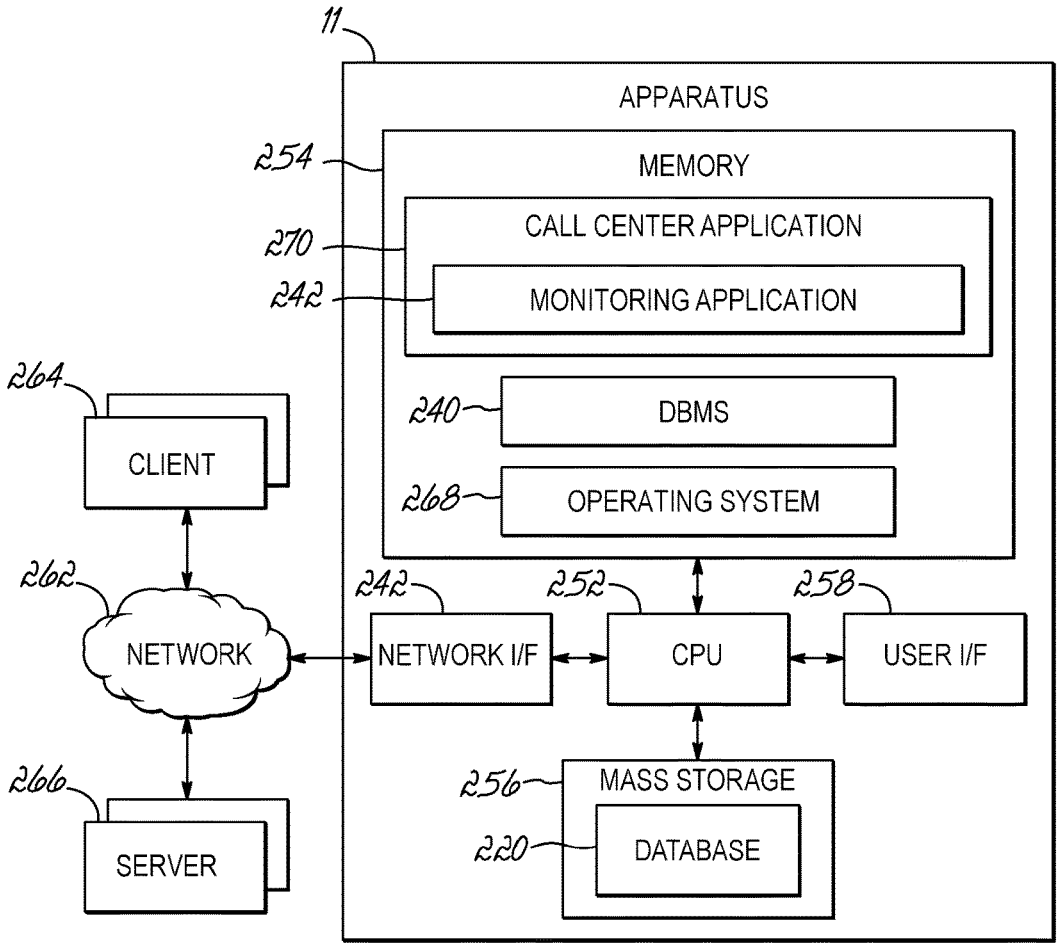
FIG. 4 is a block diagram of an exemplary hardware and software environment suitable for implementing the system of one embodiment of this invention.

Now turning to FIG. 4, an exemplary hardware and software environment in conjunction with controller 11 is illustrated. For the purposes of the invention, controller 11 may represent practically any type of computer, computer system or other programmable electronic device, and will be referred to hereinafter as a computer for simplicity. It will be appreciated, however, that apparatus 50 may be implemented using one or more networked computers, e.g., in a cluster or other distributed computing system, or may be implemented within a single computer or other programmable electronic device, e.g., a desktop computer, laptop computer, handheld computer, cell phone, set top box, etc.

Controller 11 typically includes a central processing unit 252 including at least one microprocessor coupled to a memory 254, which may represent the random access memory (RAM) devices comprising the main storage of computer 11, as well as any supplemental levels of memory, e.g., cache memories, non-volatile or backup memories (e.g., programmable or flash memories), read-only memories, etc. In addition, memory 254 may be considered to include memory storage physically located elsewhere in computer 11, e.g., any cache memory in a processor in CPU 252, as well as any storage capacity used as a virtual memory, e.g., as stored on a mass storage device 256 or on another computer coupled to computer 11. Computer 11 also typically receives a number of inputs and outputs for communicating information externally. For interface with a user or operator, computer 11 typically includes a user interface 258 incorporating one or more user input devices (e.g., a keyboard, a mouse, a trackball, a joystick, a touchpad, and/or a microphone, among others) and a display (e.g., a CRT monitor, an LCD display panel, and/or a speaker, among others). Otherwise, user input may be received via another computer or terminal.

For additional storage, computer 11 may also include one or more mass storage devices 256, e.g., a floppy or other removable disk drive, a hard disk drive, a direct access storage device (DASD), an optical drive (e.g., a CD drive, a DVD drive, etc.), and/or a tape drive, among others. Furthermore, computer 11 may include an interface 260 with one or more networks 262 (e.g., a LAN, a WAN, a wireless network, and/or the Internet, among others) to permit the communication of information with other computers and electronic devices, e.g., one or more client computers 264 (e.g., for interfacing with agents 222, 224) and one or more servers 266 (e.g., implementing other aspects of 222, 224). It should be appreciated that computer 11 typically includes suitable analog and/or digital interfaces between CPU 252 and each of components 254, 256, 258 and 260 as is well known in the art. Other hardware environments are contemplated within the context of the invention.

Computer 11 operates under the control of an operating system 268 and executes or otherwise relies upon various computer software applications, components, programs, objects, modules, data structures, etc., e.g., a call center application 270 (within which, for example, monitoring application 242 may be implemented). Moreover, various applications, components, programs, objects, modules, etc. may also execute on one or more processors in another computer coupled to computer 11 via network 262, e.g., in a distributed or client-server computing environment, whereby the processing required to implement the functions of a computer program may be allocated to multiple computers over a network.

In general, the routines executed to implement the embodiments of the invention, whether implemented as part of an operating system or a specific application, component, program, object, module or sequence of instructions, or even a subset thereof, will be referred to herein as "computer program code," or simply "program code." Program code typically comprises one or more instructions that are resident at various times in various memory and storage devices in a computer, and that, when read and executed by one or more processors in a computer, cause that computer to perform the steps necessary to execute steps or elements embodying the various aspects of the invention. Moreover, while the invention has and hereinafter will be described in the context of fully functioning controllers and computer systems, those skilled in the art will appreciate that the various embodiments of the invention are capable of being distributed as a program product in a variety of forms, and that the invention applies equally regardless of the particular type of computer readable media used to actually carry out the distribution.

Such computer readable media may include computer readable storage media and communication media. Computer readable storage media is non-transitory in nature, and may include volatile and non-volatile, and removable and non-removable media implemented in any method or technology for storage of information, such as computer-readable instructions, data structures, program modules or other data. Computer readable storage media may further include RAM, ROM, erasable programmable read-only memory (EPROM), electrically erasable programmable read-only memory (EEPROM), flash memory or other solid state memory technology, CD-ROM, digital versatile disks (DVD), or other optical storage, magnetic cassettes, magnetic tape, magnetic disk storage or other magnetic storage devices, or any other medium that can be used to store the desired information and which can be accessed by computer 11. Communication media may embody computer readable instructions, data structures or other program modules. By way of example, and not limitation, communication media may include wired media such as a wired network or direct-wired connection, and wireless media such as acoustic, RF, infrared and other wireless media. Combinations of any of the above may also be included within the scope of computer readable media.

Various program code described hereinafter may be identified based upon the application within which it is implemented in a specific embodiment of the invention. However, it should be appreciated that any particular program nomenclature that follows is used merely for convenience, and thus the invention should not be limited to use solely in any specific application identified and/or implied by such nomenclature. Furthermore, given the typically endless number of manners in which computer programs may be organized into routines, procedures, methods, modules, objects, and the like, as well as the various manners in which program functionality may be allocated among various software layers that are resident within a typical computer (e.g., operating systems, libraries, API's, applications, applets, etc.), it should be appreciated that the invention is not limited to the specific organization and allocation of program functionality described herein.

In the embodiment shown in FIG. 3, the female scoring wheel 102*d* of each carton scoring wheel assembly 102*a* is in contact with the lower non-print side 21 of the substrate 14 and the male scoring wheel 102*c* of each scoring wheel assembly 102*a* engages the upper print side 20 of the substrate 14. One aspect of this invention is the ability to modify or change the particular configuration of the male and female scoring wheels 102*c*, 102*d* thereby providing for a variety of different crease and score lines 24, configurations, widths and geometries on the substrate 14. Advantageously, the position of the individual carton scoring wheel assemblies can be adjusted on the fly during operation of the system 10 for different scoring patterns for each substrate 14 while avoiding downtime and interruption of production of carton blanks 12.

One aspect of this invention allows for the production of a variety of carton blanks 12 based upon algorithms input to the controller 11 whereby every carton for a production run can be slightly different in both print and size, yet still run through standard automatic filling equipment. In other words, random and/or programmed variation can occur within the confines of acceptable process variation, which results in mass production of different dimensioned carton blanks 12. For example, two adjacent pairs of the major panels no of a carton blank form a first pair of panels and combine to a certain total width and the remaining two of the major panels no of the carton blank combine to form a second pair of panels having the same total width; however, the individual dimensions of each panel in the first pair may be varied and the individual dimensions of each panel in the second pair may be varied from carton blank to carton blank. As such, each carton blank produced according to this aspect of this invention appears to be differently dimensioned from each other carton blank while all of the various carton blanks form a parallel-piped carton configuration and appear to be individually manufactured and not the result of a high-speed continuous digital printing, digital scoring and digital cutting continuous production process.

From the above disclosure of the general principles of this invention and the preceding detailed description of at least one embodiment, those skilled in the art will readily comprehend the various modifications to which this invention is susceptible.

I claim:

1. A method for digitally scoring a carton blank substrate comprising the steps of:

inputting digital input into a controller in communication with a scoring assembly and a carton blank substrate turning assembly to produce a desired scoring pattern on the carton blank substrate according to the digital input;

communicating at least selected portions of the digital input to the scoring assembly;

conveying the carton blank substrate to and between the scoring assembly and the carton blank substrate turning assembly;

scoring a first set of score lines in a first direction on the carton blank substrate with the scoring assembly according to the digital input;

turning the carton blank substrate while within the scoring assembly with the carton blank substrate turning assembly from a first orientation to a second orientation; and scoring a second set of score lines in a second direction on the carton blank substrate with the scoring assembly according to the digital input.

2. The method of claim 1 wherein each of the scoring steps further comprise scoring first and second sets of score lines, respectively, which are each generally linear.

3. The method of claim 1 wherein the second scoring step further comprises scoring the second set of score lines generally perpendicular to the first set of score lines.

4. The method of claim 1 wherein the turning step further comprises turning the carton blank substrate about 90 degrees.

5. The method of claim 1 wherein the scoring and turning steps are performed in the relative order as recited in claim 1.

6. The method of claim 1 wherein the scoring steps are performed with a plurality of scoring members.

7. The method of claim 6 wherein the plurality of scoring members are arranged in a plurality of pairs of the scoring members;

wherein each pair of scoring members further comprises a female scoring member contacting a first face of the carton blank substrate and a male scoring member contacting a second face of the carton blank substrate, the male and female scoring members of each pair of scoring members being positioned opposite from one another and cooperating to score the carton blank substrate.

8. The method of claim 7 further comprising:

rotating at least some of the plurality of scoring members during engagement with the carton blank substrate.

9. The method of claim 1 further comprising:

adjusting components of the scoring assembly in a lateral direction to position at least some of the first and second sets of score lines on the carton blank substrate according to the digital input.

10. A method for digitally scoring a carton blank substrate comprising the steps of:

inputting digital input into a controller in communication with a scoring assembly and a carton blank substrate turning assembly to produce a desired scoring pattern on the carton blank substrate according to the digital input;

communicating at least selected portions of the digital input to the scoring assembly;

conveying the carton blank substrate in a generally downstream direction along a longitudinal centerline of and to and between the scoring assembly and the carton blank substrate turning assembly;

scoring a first set of score lines in a first direction on the carton blank substrate with the scoring assembly according to the digital input;

turning the carton blank substrate while within the scoring assembly with the carton blank substrate turning assembly from a first orientation to a second orientation; and scoring a second set of score lines in a second direction on the carton blank substrate with the scoring assembly according to the digital input.

11. A method for digitally scoring a carton blank substrate comprising the steps of:

inputting digital input into a controller in communication with a scoring assembly and a carton blank substrate turning assembly to produce a desired scoring pattern on the carton blank substrate according to the digital input;

communicating at least selected portions of the digital input to the scoring assembly;

conveying the carton blank substrate in a generally downstream direction to and between the scoring assembly and the carton blank substrate turning assembly;

scoring a first set of score lines in a first direction on the carton blank substrate with the scoring assembly according to the digital input;

turning the carton blank substrate while within the scoring assembly with the carton blank substrate turning assembly from a first orientation to a second orientation; and scoring a second set of score lines in a second direction on the carton blank substrate with the scoring assembly according to the digital input.

* * * * *